United States Patent [19]

Haig

[11] 4,027,050

[45] May 31, 1977

[54] METHOD AND APPARATUS FOR ELECTROSTATIC COATING

[76] Inventor: Frederic David Haig, 265 Queens Pde., Clifton Hill, Victoria, Australia, 3068

[22] Filed: July 10, 1975

[21] Appl. No.: 594,852

[52] U.S. Cl. ..... 427/27; 118/621

[51] Int. Cl.[2] ..... B05B 5/02; B05D 1/06

[58] Field of Search ..... 427/27; 118/621

[56] References Cited

UNITED STATES PATENTS

| | | | |
|---|---|---|---|
| 3,083,121 | 3/1963 | Gauthier | 118/621 X |
| 3,412,198 | 11/1968 | Wallis | 118/621 X |
| 3,691,991 | 9/1972 | Luderer et al. | 118/621 X |
| 3,735,925 | 5/1973 | Benedek et al. | 118/621 X |

*Primary Examiner*—James R. Hoffman

*Attorney, Agent, or Firm*—Andrus, Sceales, Starke & Sawall

[57] ABSTRACT

A method of coating an article comprising passing a coating material adjacent to a plurality of conductors connected to a high voltage source whereby to electrostatically charge the material and wherein each of the conductors is connected to said source through an impedance adapted to resist reduction of charge on a conductor relatively remote from an articles to be coated in consequence of reduction of charge on a conductor relatively adjacent to said article to be coated. The coating material may be supplied from a powder dispensing and metering device comprising a powder reservoir, a rotor mounted for rotation at the base of the reservoir and an air inlet adjacent the rotor through which air is drawn in use to mix with powder during rotation of the rotor to draw a powder-air mixture away from the reservoir.

12 Claims, 7 Drawing Figures

METHOD AND APPARATUS FOR ELECTROSTATIC COATING

BACKGROUND OF THE INVENTION

1. Field of the Invention

This invention relates to electrostatics. In a particular aspect, this invention relates to the electrostatic application of material, particularly powders. In another aspect, this invention relates to an applicator for an electrostatically charged material. In another aspect this invention relates to an electrostatic gun.

2. Description of the Prior Art

It is known to electrostatically charge material such as liquids and powders and to spray the material onto a grounded article. Because of the electrostatic charge, the material will tend to cling to the article and thereafter the article may be subjected to a treatment such as drying or heating to bond the material to the article. Particular instances of this technique are spray painting of articles and coating articles with thermoplastic or thermosetting synthetic plastics materials which are thereafter heat treated to form an attractive and durable coating on the article.

In one known apparatus a stream of air in which a thermoplastic or thermosetting synthetic plastic material is entrained is passed to a gun which is directed by an operator at an object to be coated. The gun has an outlet nozzle for the air and entrained material and surrounding that nozzle is a single conductor which is charged with a high voltage.

Partly due to the entrained material passing in proximity to the conductor and partly due to the conductor ionizing air adjacent to itself, the entrained material becomes charged and, because the article to be coated is grounded, is attracted thereto.

However, a number of difficulties arise out of the use of the above described apparatus.

One difficulty is that although the conductor surrounds the nozzle, the field produced by the conductor tends to originate from the region of the conductor most adjacent to the article to be coated and in other regions of the conductor a comparatively small field is produced. Thus the entrained material which passes adjacent said other regions may not pick up sufficient charge and, in consequence, the article may be unevenly coated and/or entrained material, by not being strongly attracted to the article, may not, in fact, cling to the article and may instead be dissipated into the atmosphere.

Another difficulty is that the stronger the electrostatic field the greater is the tendency for the material to coat the article in those regions closest to the conductor rather than those areas remote from the conductor and, further, the less the tendency to coat hollow and recessed regions of the article.

SUMMARY OF THE INVENTION

The present invention provides a method of coating an article comprising passing a coating material adjacent to a plurality of conductors connected to a high voltage source whereby to electrostatically charge the material and wherein each of the conductors is connected to said source through an impedance adapted to resist reduction of charge on a conductor relatively remote from an article to be coated in consequence of reduction of charge on a conductor relatively adjacent to said article to be coated.

The actual magnitude of the impedances should be chosen to suit the particular case but, for guidance, applicant suggests that for a high voltage source capable of charging the conductors to 20 to 90 KV and for use with thermoplastic or thermosetting synthetic plastics coating powders the use of impedances of greater than 10 megaohm is desirable and 30 megaohm or greater is more preferred. It is not considered that there is an upper limit on the magnitude of the impedances but, for practical reasons, 100 megaohm will be a useful upper limit.

For reasons of cost, each impedance may comprise a number of series connected impedances.

The above aspect of the invention has the advantage that a greater proportion of the coating material will be relatively highly charged and a lesser proportion will be relatively lower charged as compared to the situation if the impedances were not used where a greater proportion would be relatively lowly charged and a lesser proportion would be relatively higher charged.

Further, the fields produced by each of the conductors will, together, have a wide spread as compared with the field which which would be produced with a single conductor and the field which would be produced by a plurality of conductors if the impedances were not used.

The present invention also provides an applicator gun through which a coating material is passed, in use, the gun including a plurality of conductors connected, in use to a high voltage source whereby to electrostatically charge the material and including an impedance for each conductor adapted, when connected to said source, to resist reduction of charge on a conductor relatively remote from an article to be coated in consequence of reduction of charge on a conductor relatively adjacent to said article to be coated.

It is particularly preferred that the coating material is caused to pass closely adjacent to the conductors. Thus, the gun preferably includes means to achieve this but since some coating materials will accept an electrostatic charge more readily than others it is preferred that means be interposed in the path of the coating material to direct, optionally, a greater or lesser part of the material closely adjacent to the conductors.

The present invention also provides a method of coating an article comprising passing a coating material adjacent to at least one conductor connected to a high voltage source whereby to electrostatically charge the material and periodically reducing the charge at said at least one conductor whereby to periodically vary the electrostatic charge applied to the material.

The present invention also provides coating material applicator apparatus comprising at least one conductor, a high voltage source connected to said at least one conductor, means for passing coating material adjacent to the conductor whereby, in use, to electrostatically charge the material and means for periodically reducing the charge at said at least one conductor whereby, in use, to periodically vary the electrostatic charge applied to the material.

As a result of the above, the tendency to coat those regions of an article to be coated adjacent to said at least one conductor in preference to regions, particularly hollows and recesses, remote from said at least one conductor will be reduced.

The periodicity of reduction of charge and the extent of charge reduction preferably can be varied to suit different situations.

In general, applicant has found that a preferred periodicity of charge reduction is from 10 to 100 times per minute with 15–25 times per minute being more preferred. Further, a complete switch off of high tension means is preferred but circuit capacitance usually results in charge not falling to zero.

The present invention also provides a powder dispensing and metering device for an electrostatic powder applicator comprising a powder reservoir, a rotor mounted for rotation at the base of the reservoir and an air inlet adjacent the rotor through which air is drawn in use to mix with powder during rotation of the rotor to draw a powder-air mixture away from the reservoir.

Preferably, the reservoir delivers powder to the rotor only at a position remote from the air inlet.

Preferably, the rotor comprises a plurality of vanes.

A specific construction of apparatus in accordance with this invention will now be described with the aid of the accompanying drawings which are given by way of example only and are not to be considered as limiting.

DETAILED DESCRIPTION

Figure 1:
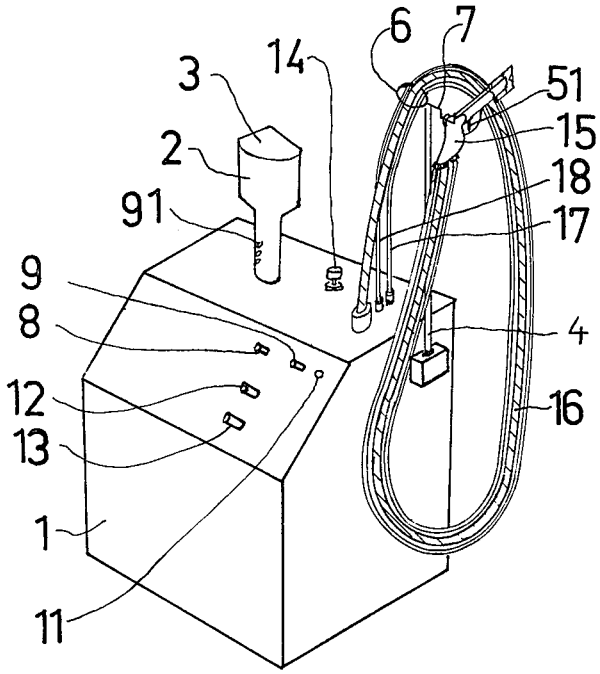
FIG. 1 is a front perspective view of an electrostatic coating apparatus.
Figure 2:
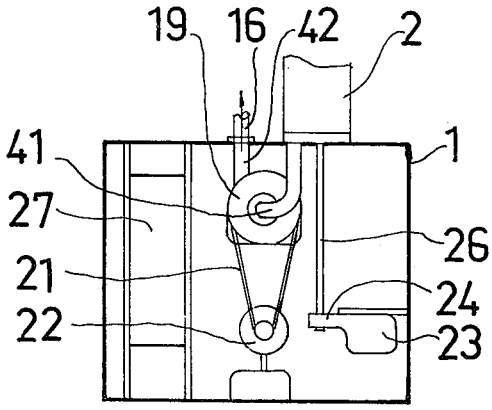
FIG. 2 is a rear elevational view of part of the apparatus shown in FIG. 1.
Figure 5:
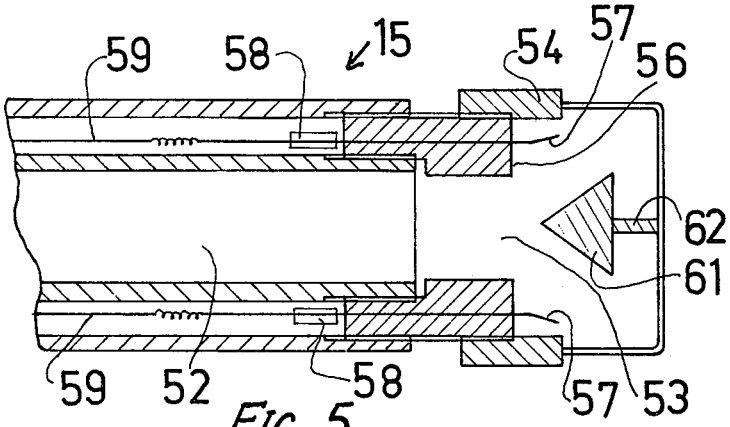
FIG. 5 is a cross-section through part of the apparatus shown in FIG. 1.
Figure 6:
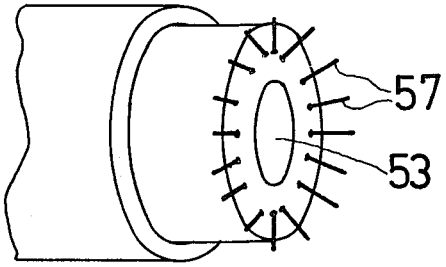
FIG. 6 is a detail of part of the apparatus shown in FIG. 1.
Figure 3:
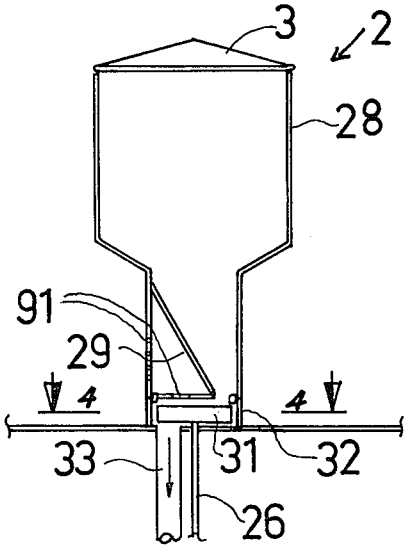
FIG. 3 is a cross-section through part of the apparatus shown in FIG. 1.
Figure 4:
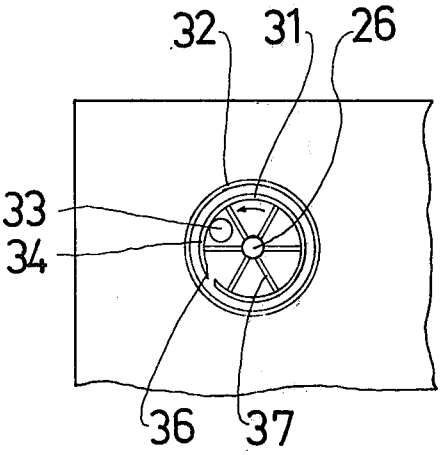
FIG. 4 is a cross-section on line 4 — 4 in FIG. 3.

The apparatus shown in the drawings comprises a casing 1 provided with a powder hopper 2 having a lid 3 and a stand 4 including a ring 6 and a hook 7. Fitted to the casing is a main on-off switch 8, a fuse 9, an indicator light 11 to indicate when the apparatus is on, a first multiposition rotary switch 12, a second multiposition rotary switch 13 and a terminal 14.

The hook 7 supports a gun 15 which is connected to the casing by a hose 16, first cable 17 and a second cable 18.

Within the casing is a blower 19 which is driven by belt 21 from a first motor 22 and a second motor 23 which, through a gear box 24, drives a shaft 26.

Certain electrical components are housed within a housing 27 within the casing.

The hopper 2 includes a bin portion 28 and a chute 29 which delivers powder to one side of a metering apparatus. The metering apparatus comprises a rotor 31 mounted for rotation by shaft 26 in an open topped and closed bottom cylinder 32 on which the hopper 2 sits. The bottom of the cylinder 32 is provided with an outlet 33 which, it is to be noted, is located to the opposite side of the cylinder to the side to which the chute 29 delivers powder.

The rotor 31 comprises an annulus 34 which is slotted to form an edge at 36 which will tend to scrape away powder tending to cake against the wall of the cylinder 32. The rotor also comprises a number of vanes 37.

Co-operation of the vanes 37, annulus 34 and the positioning of the chute 29 will result in the rotor delivering metered amounts of powder to the outlet 33; which metered amounts will depend on the volume defined by adjacent vanes 37 and the annulus 34 and the speed of rotation of the rotor 31 by shaft 26.

The blower 19 has an inlet 41 and an outlet 42. The inlet 41 is connected to the outlet 33 of the cylinder 32 and thus air will be drawn through the hopper 2 and cylinder 32 and in so doing the powder will be entrained in air and fluidized.

The outlet 42 passes through the casing 1 and is connected to the hose 16 through a snap-coupling (not shown). Thus, in use, fluidized powder will be passed to the gun when the blower 19 and rotor 31 are operating.

The gun includes a trigger 51 which, through cable 17, can cause certain operations to commence or cease as will be explained later.

The cable 18 supplies a high voltage to the gun.

The gun includes a bore 52 having an outlet 53, a shield 54 screw threads or otherwise secured to the end 56 of the gun so as to be movable axially with respect to the gun and a plurality of conductors 57. The conductors 57 are connected through impedances 58 and cables 59 to cable 18. The shield 54 carries a conical deflector 61 which is screw threaded or otherwise secured to a shaft 62 for axial movement.

In use, air and powder issue from outlet 53 and by adjusting the position of the shield 54 and deflector 61 the breadth of spread of powder and the length of path of powder maintained proximate to the conductors 57 may be varied.

The electrical circuit of the apparatus will now be explained with particular reference to FIG. 7.

Figure 7:
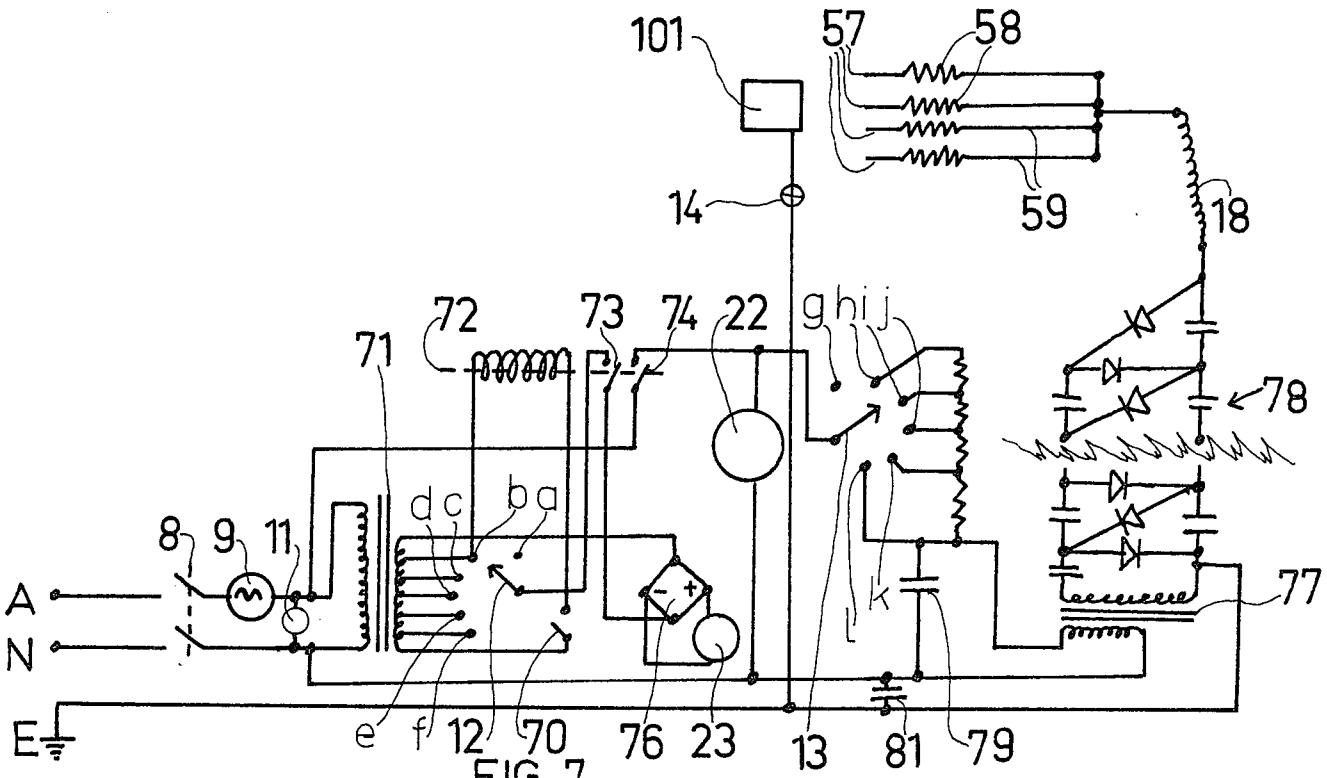
FIG. 7 is a diagram of the electric circuit of the apparatus shown in FIG. 1.

In FIG. 7 is shown connections A and N to a mains electrical supply, the main on-off switch 8 (which is a two pole single throw switch), the fuse 9 and the indicator light 11.

Also shown is a step down transformer 71, the switch 12 which is selectively connectable to terminals $a-f$ ($a$ being off and $b-f$ being to different voltage tappings of the transformer), a switch 70 which is operated by the trigger 51 of the gun, a relay 72 including a switch 73 and a switch 74, a rectifier 76, the motor 23 (which is a DC motor) which drives the shaft 26, the motor 22 which drives the blower 19, the switch 13 which is selectively connectable to terminals $g-l$ ($g$ being off and $h-l$ being through different resistances to a high tension transformer 77, and a cascade multiplier which is indicated generally by 78.

The output of the cascade multiplier is connected to the cable 18.

A ground connection is also shown in FIG. 7 and it is to be noted that the terminal 14 is connected thereto.

Capacitors 79 and 81 act as circuit and personal injury protection devices.

To ready the apparatus, powder is placed in the hopper 2 and the terminals A and N are connected to a mains electricity supply.

The manner of operation of the apparatus is as follows.

Switches 12 and 13 are moved to positions other than the off position.

The main on-off switch 8 is closed as a result the apparatus is partially activated.

Operation of the trigger 51 will cause closing of the switch 70 which will cause actuation of the relay 72 which causes closing of switches 73 and 74.

Switch 74 causes the motor 22 to commence operation and switch 73 causes the motor 23 to rotate at a speed dependent on the positioning of switch 12.

In consequence, powder will be delivered to the gun 15.

Closing of switch 74 also causes actuation of the transformer 77 and a high voltage output will pass from the cascade multiplier 78 to the cable 18 and from there, through the impedances 58, to the conductors 57. Selective positioning of the switch 13 will determine the voltage at the conductors 57.

An article 101 to be coated is connected to terminal 14.

As the result of the powder passing closely adjacent to the conductors 57 it will become charged and will be attracted to the article 101. Further, although any one conductor 57 adjacent the article 101 may lose its field due to the proximity, the other conductors 57 will, because of the impedances 58, not all lose their fields and the total field will be more widely spread than if the impedances 58 were not used or if a single conductor was used.

To cause the high tension to pulse, a micro switch may be included in cable 18 and may be caused to interupt current flow therealong by means of a cam actuating the micro switch and driven by a motor.

The above described electrostatic coating apparatus performs excellently in use and can be used to coat articles with a variety of powders such as epoxy resin and polythene. The apparatus also works excellently with nylon powder which, normally, is difficult to apply but it is to be noted that in applying nylon it is preferred that the conductors 57 are positively charged.

Modifications and adaptions may be made to the above described without departing from the spirit and scope of this invention which includes every novel feature and combination of features disclosed herein.

Air holes 91 are provided in the hopper to admit air to entrain with powder.

The claims form part of the disclosure of this specification.

The present invention can be applied to the application of materials other than those discussed above; for instance, it can be used to apply talc and ceramics and also paint or any other pulverulent or droplet material.

I claim:

1. A method of coating an article comprising passing a coating material adjacent to a plurality of conductors connected to a high voltage source whereby to electrostatically charge the material and wherein each of the conductors is connected to said source through an impedance having a magnitude sufficient to resist reduction of charge on a connector relatively remote from an article to be coated in consequence of reduction of charge on a conductor relatively adjacent to said article to be coated.

2. A method as claimed in claim 1, wherein the high voltage source produces a voltage of from 20–90 KV and wherein the impedances have a value of 10 megaohm or greater.

3. A method as claimed in claim 1 including periodically reducing the charge at the conductors whereby to periodically reducing the charge at the conductors whereby to periodically vary the electrostatic charge applied to the material.

4. A method as claimed in claim 3, wherein the periodicity of reduction of charge is from 10 to 100 times per minute.

5. An applicator gun apparatus through which a coating material is passed in use, the gun of said apparatus including a plurality of conductors connected, in use, to a high voltage source whereby to electrostatically charge the material and including an impedance for each conductor having a magnitude sufficient, when connected to said source, to resist reduction of charge on a conductor relatively remote from the article to be coated in consequence of reduction of charge on a conductor relatively adjacent to said article to be coated.

6. The apparatus as claimed in claim 5, wherein the impedances each have a value of 10 megaohm or greater.

7. The apparatus as claimed in claim 5 wherein said gun includes a sleeve means which, in use, surrounds material issuing from the gun; the sleeve means being movable whereby to vary the spread of material issuing from the gun.

8. The apparatus as claimed in claim 5 wherein said gun includes a deflector means located in the path traversed, in use, by material issuing from the gun; the deflector means being movable whereby to vary the spread of material issuing from the gun.

9. An applicator gun apparatus as claimed in claim 5 further defined as including a high voltage source connected to the conductors and means for periodically reducing the charge at the conductors whereby, in use, to periodically vary the electrostatic charge applied to the material.

10. An applicator gun apparatus as claimed in claim 5, further defined as including a dispensing and metering device therefor; said device comprising a reservoir for powdered coating material, a rotor mounted for rotation at the base of the reservoir and an air inlet adjacent the rotor through which air is drawn in use to mix with the material during rotation of the rotor to draw a material-air mixture away from the reservoir and means connected to said reservoir and said gun for passing the material past the conductors to electrostatically charge the material.

11. An applicator gun apparatus as claimed in claim 10, wherein the reservoir is adapted to deliver powder to rotor only at a position remote from the air inlet.

12. An applicator gun apparatus as claimed in claim 10, wherein the rotor comprises a plurality of vanes.

* * * * *